US008816606B2

(12) United States Patent
Jin

(10) Patent No.: US 8,816,606 B2
(45) Date of Patent: Aug. 26, 2014

(54) LIPS BACKLIGHT CONTROL ARCHITECTURE WITH LOW COST DEAD TIME TRANSFER

(75) Inventor: Xiaoping Jin, Orange, CA (US)

(73) Assignee: Microsemi Corporation, Aliso Viejo, CA (US)

( * ) Notice: Subject to any disclaimer, the term of this patent is extended or adjusted under 35 U.S.C. 154(b) by 563 days.

(21) Appl. No.: 13/158,507

(22) Filed: Jun. 13, 2011

(65) Prior Publication Data

US 2011/0304280 A1 Dec. 15, 2011

Related U.S. Application Data

(60) Provisional application No. 61/354,754, filed on Jun. 15, 2010.

(51) Int. Cl.
*H05B 37/02* (2006.01)
*H05B 41/282* (2006.01)

(52) U.S. Cl.
CPC ..... *H05B 41/2825* (2013.01)
USPC ..... 315/307; 315/291; 315/297; 315/278; 336/30; 323/355

(58) Field of Classification Search
CPC ..... H05B 37/02
USPC ..... 315/307, 219; 336/30; 323/355
See application file for complete search history.

(56) References Cited

U.S. PATENT DOCUMENTS 3,979,640 A 9/1976 Fischman et al.
4,020,361 A 4/1977 Sulzle et al.
4,030,015 A 6/1977 Herko et al.
4,176,258 A * 11/1979 Jackson ..... 714/30
4,278,918 A 7/1981 Bachofer
4,694,384 A 9/1987 Steigerwald et al.
4,758,941 A 7/1988 Felton et al.
4,995,054 A 2/1991 Eckersley
5,109,185 A 4/1992 Ball
5,168,182 A 12/1992 Salerno et al.
5,541,827 A 7/1996 Allfather
5,615,093 A 3/1997 Nalbant
5,757,141 A 5/1998 Wood
6,107,754 A * 8/2000 Kim ..... 315/291
6,259,615 B1 7/2001 Lin
6,396,722 B2 5/2002 Lin
6,469,454 B1 10/2002 Mader et al.
6,862,195 B2 3/2005 Jitaru (Continued)

OTHER PUBLICATIONS

International Search Report for PCT/US2011/031489—European Patent Office mailed Jun. 30, 2011.

(Continued)

*Primary Examiner* — Alexander H Taningco
*Assistant Examiner* — David Lotter
(74) *Attorney, Agent, or Firm* — Simon Kahn

(57) ABSTRACT

A driving circuitry arranged to pass a dead time over an isolation transformer, the driving circuitry constituted of: a three-state driver arranged to output a first signal, the first signal selectively at one of two complementary voltage levels and a high impedance state; a first capacitor, a first end of the first capacitor coupled to receive the first signal; and a first isolation transformer, a first end of a first winding of the first isolation transformer coupled to a second end of the first capacitor.

20 Claims, 6 Drawing Sheets

(56) References Cited

U.S. PATENT DOCUMENTS

| | | | | |
|---|---|---|---|---|
| 7,158,573 | B2 | 1/2007 | Hershbarger | |
| 7,242,147 | B2 * | 7/2007 | Jin | 315/177 |
| 7,291,987 | B2 * | 11/2007 | Chang et al. | 315/282 |
| 7,508,142 | B2 * | 3/2009 | Green | 315/224 |
| 2002/0154519 | A1 | 10/2002 | Nakahara et al. | |
| 2005/0078103 | A1 | 4/2005 | Tikhonski et al. | |
| 2005/0093731 | A1 | 5/2005 | Skov et al. | |
| 2005/0099143 | A1 * | 5/2005 | Kohno | 315/312 |
| 2006/0017406 | A1 * | 1/2006 | Ball | 315/308 |
| 2006/0108933 | A1 | 5/2006 | Chen | |
| 2006/0112393 | A1 * | 5/2006 | Benayoun et al. | 718/102 |
| 2006/0218424 | A1 * | 9/2006 | Abramovici et al. | 713/323 |
| 2006/0284568 | A1 * | 12/2006 | Chang et al. | 315/282 |
| 2006/0284575 | A1 * | 12/2006 | Shen et al. | 315/312 |
| 2007/0013321 | A1 | 1/2007 | Ito et al. | |
| 2007/0138874 | A1 * | 6/2007 | Kong | 307/116 |
| 2008/0018262 | A1 * | 1/2008 | Green | 315/225 |
| 2008/0018266 | A1 | 1/2008 | Yu et al. | |
| 2008/0164828 | A1 | 7/2008 | Szczeszynski et al. | |

OTHER PUBLICATIONS

Written Opinion for PCT/US2011/031489—European Patent Office mailed Jun. 30, 2011.

Choi, Kevin; LX1691, LX1691A, LX1691B Enhanced Multi-Mode CCFL Controller—AN-33; Microsemi, Garden Grove, California; 2004.

* cited by examiner 600
610
620
630
640
650
AOH
AOL
BOH
BOL
AOUT
HIGH-Z
VGS1
0V
VGS2
0V
BOUT
HIGH-Z
VGS3
0V
VGS4
0V
V1
0V

LIPS BACKLIGHT CONTROL ARCHITECTURE WITH LOW COST DEAD TIME TRANSFER

CROSS REFERENCE TO RELATED APPLICATIONS

This application claims priority from U.S. Provisional Patent Application Ser. No. 61/354,754 filed Jun. 15, 2010 entitled "LIPS BACKLIGHT CONTROL ARCHITECTURE WITH LOW COST DEAD TIME TRANSFER", the entire contents of which is incorporated herein by reference.

TECHNICAL FIELD

The present application relates to the field of lighting, and more particularly to an arrangement in which a lighting controller transfers a dead time between switching patterns across an isolation transformer.

BACKGROUND OF THE INVENTION

Fluorescent lamps and light emitting diodes (LEDs) are used in a number of applications including, without limitation, backlighting of display screens, televisions and monitors and general lighting applications. One particular type of fluorescent lamp is a cold cathode fluorescent lamp (CCFL). Such lamps require a high starting voltage (typically on the order of 700 to 1,600 volts) for a short period of time to ionize a gas contained within the lamp tubes and fire or ignite the lamp. This starting voltage may be referred to as a strike voltage or striking voltage. After the gas in a CCFL is ionized and the lamp is fired, less voltage is needed to keep the lamp on.

In liquid crystal display (LCD) applications, a backlight is needed to illuminate the screen so as to make a visible display. Backlight systems in LCDs or other applications typically include one or more CCFLs and an inverter system to provide both DC to AC power conversion and control of the lamp brightness. Even brightness across the panel and clean operation of inverters with low switching stresses, low EMI, and low switching losses is desirable. While CCFL backlighting is common, other fluorescent lamps such as external electrode fluorescent lamps (EEFLs) or flat fluorescent lamps (FFLs) may be utilized in place of CCFLs, with somewhat similar requirements. With the increasing size of LCDs and the high screen brightness requirements for better display quality, the power consumption of the backlight system becomes a major factor in the total system power consumption of an LCD based monitor or television.

In many prior art systems, the incoming power line voltage is first rectified, and a power factor corrector (PFC) is typically provided. The rectified voltage is then converted to a low voltage, typically on the order of 24 volts, and the low voltage is fed to a backlight controller. The backlight controller controls a switching network connected to the primary side of a transformer, and the fluorescent lamps are connected to the secondary side of the transformer. The backlight controller is operative to produce the necessary AC driving voltage by controlling the operation of the individual switches of the switching network. Such an operation is described, for example, in U.S. Pat. No. 5,615,093 issued Mar. 27, 1997 to Nalbant, the entire contents of which is incorporated herein by reference.

Unfortunately, the above architecture leads to excessive power loss, since an incoming AC line voltage is first converted to a high voltage DC, the high voltage DC is then converted to a low voltage DC, and the low voltage DC is then again converted to a higher AC voltage for driving the fluorescent lamps. In a move to reduce power consumption, an architecture called LCD Integrated Power Systems (LIPS) has been developed. For example, ON Semiconductor has published a GreenPoint reference design, certain selected portions of which are shown in FIG. 1. In particular, the LIPS architecture of FIG. 1 comprises: An A/C line source 10; an EMI filter 20; a full wave rectifier 30; a PFC circuit 40; a switching network 50; an output transformer 60; a backlight controller 70; current sensing and over-voltage detecting circuitry 80; a balancing network 90; a plurality of lamps 100, each illustrated without limitation as a CCFL; and a plurality of isolation circuits 110. PFC circuit 40 comprises a transformer, a PFC controller, a resistor, an electronically controlled switch, a diode and an output capacitor. Switching network 50 comprises a plurality of electronically controlled switches, illustrated, without limitation, as NMOSFETs. Output transformer 60 exhibits a single primary winding magnetically coupled to a pair of secondary windings. Current sensing and over-voltage detecting circuitry 80 comprises a pair of capacitor voltage dividers connected to a secondary side common point, and a resistor connected between the two secondary windings and the secondary side common point. Balancing network 90 comprises a plurality of balancing transformers, each associated with a particular lamp 100. Balancing network 90 is arranged so that current is received at one end of each lamp 100 via a respective balancing transformer primary winding, and the secondary windings of the balancing transformers are connected to form an in-phase closed loop. The arrangement of balancing network 90 is further taught in U.S. Pat. Ser. No. 7,242,147 issued Jul. 10, 2007 to Jin, the entire contents of which is incorporated herein by reference. In an exemplary embodiment, backlight controller 70 is constituted of an LX 6503 Backlight Controller available from Microsemi Corporation, Garden Grove, Calif. The second end of each lamp 100 is connected to the secondary side common point.

The output of A/C line source 10 is received by EMI filter 20, and the output of EMI filter is connected to the input of full wave rectifier 30. The output of full wave rectifier 30 is fed to PFC circuit 40, and the output of PFC circuit 40 is fed to switching network 50. The output of switching network 50 is connected to the primary winding of output transformer 60, and the secondary windings of output transformer 60 are connected to each of the plurality of CCFL lamps 100 via balancing network 90. The current sense output of current sensing and over-voltage detecting circuitry 80 is connected to a respective input of backlight controller 70, and the over-voltage detecting output of current sensing and over-voltage detecting circuitry 80 is connected to a respective input of backlight controller 70. A PWM dimming input, denoted PWM DIM, an analog dimming input, denoted ANALOG DIM, an enable input, denoted ENABLE, and a synchronization input, denoted SYNCH, preferably sourced by a separate video processor (not shown), are further fed to respective inputs of backlight controller 70. The in-phase closed loop formed by the secondary windings of the balancing transformers of balancing network 90 is also coupled to a respective input of backlight controller 70. Backlight controller 70 exhibits a plurality of outputs, which are each fed via a respective isolation circuit 110 to the control input of the respective electronically controlled switch of switching network 50.

Switching network 50 is preferably a full bridge network comprising 4 electronically controlled switches, due to its inherent ability to provide soft switching while providing lamp current regulation with pulse width modulation. The full bridge network can be replaced with a half bridge switching work, thereby reducing cost, however there is often a penalty of severe ringing at turn off due to the hard switching behavior associated with half bridge switching with resulting high switching losses and strong EMI emissions. These problems can be mitigated with additional circuitry; however this again increases the cost. Alternatively, a resonant half bridge switching method may be implemented; however resonant operation varies the switching frequency with operating conditions which is not favored in many display applications. In order to minimize cost, isolation circuits 110 are typically implemented as low cost transformers.

The output of PFC circuit 40 is normally in the range of 375V to 400VDC, and in the LIPS architecture of FIG. 1, this voltage is directly used to drive the primary winding of output transformer 60 responsive to switching network 50, without requiring a voltage step down. This approach thus provides significant cost savings and efficiency improvements as opposed to earlier prior art applications because of the removal of the DC to DC converter stage for the inverter input.

One of the challenges of the LIPS architecture of FIG. 1 is that in order to maintain soft switch operation at least one arm of the full bridge should stay in complementary switching status, i.e. ignoring any required dead time to avoid shoot through, the high side and low switch of the arm should turn on and off alternatively and only during the dead time period are both switches of the arm turned off.

In order to reduce cost, isolation circuits 110 are preferably implemented as transformers, however transformers can only reliably transfer FET drive signals when the length of time of the positive going section of the waveform matches that of the negative going section of the waveform, since the total of areas of the curve above and below zero must be equal to avoid DC bias or saturation. Thus, the use of a PWM drive for switching network 50 is problematic, since as the duty cycle changes the resultant drive voltage seen by switching network 50 changes, unless additional circuitry is provided.

Alternatively, phase shifting between the switches of the arms may be utilized. In particular, in a phase shifted arrangement, switches of arms are driven with a balanced signal, each exhibiting a near 50% duty cycle, and the relative phase of the drive signals are used to control power. Unfortunately, the prior art requires 4 signals to be transferred over isolation circuitry 110 in order to properly drive switching network 50 with such a phase shifted arrangement.

The above has been explained in some detail in regards to a CCFL arrangement; however those skilled in the art recognize that similar issues are found with LED lighting. LED lighting is similarly driven responsive to an AC mains power signal, which after an appropriate PFC stage exhibits a high voltage DC, typically significantly in excess of the DC required to actually drive an LED string. Thus, the voltage must be converted to a different DC voltage, thus increasing cost and again suggesting the use of a LIPS architecture.

What is needed, and not supplied by the prior art, is a LIPS architecture arrangement which provides for low cost isolation circuitry.

SUMMARY

In view of the discussion provided above and other considerations, the present disclosure provides methods and apparatus to overcome some or all of the disadvantages of prior and present LIPS architectures. Other new and useful advantages of the present methods and apparatus will also be described herein and can be appreciated by those skilled in the art.

This is provided in certain embodiments by an arrangement in which an isolation transformer is driven by a drive signal exhibiting a high state, a low state and a high impedance state. Preferably, the drive signal is coupled to the isolation transformer by a capacitor. Advantageously, the drive signal may be coupled to a single end of the primary winding of the isolation transformer, with a second end of the primary winding connected to a common potential point, such as ground.

Additional features and advantages of the invention will become apparent from the following drawings and description.

BRIEF DESCRIPTION OF THE DRAWINGS

For a better understanding of the invention and to show how the same may be carried into effect, reference will now be made, purely by way of example, to the accompanying drawings in which like numerals designate corresponding elements or sections throughout.

With specific reference now to the drawings in detail, it is stressed that the particulars shown are by way of example and for purposes of illustrative discussion of the preferred embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice. In the accompanying drawings.

DETAILED DESCRIPTION OF PREFERRED EMBODIMENTS

Figure 1:
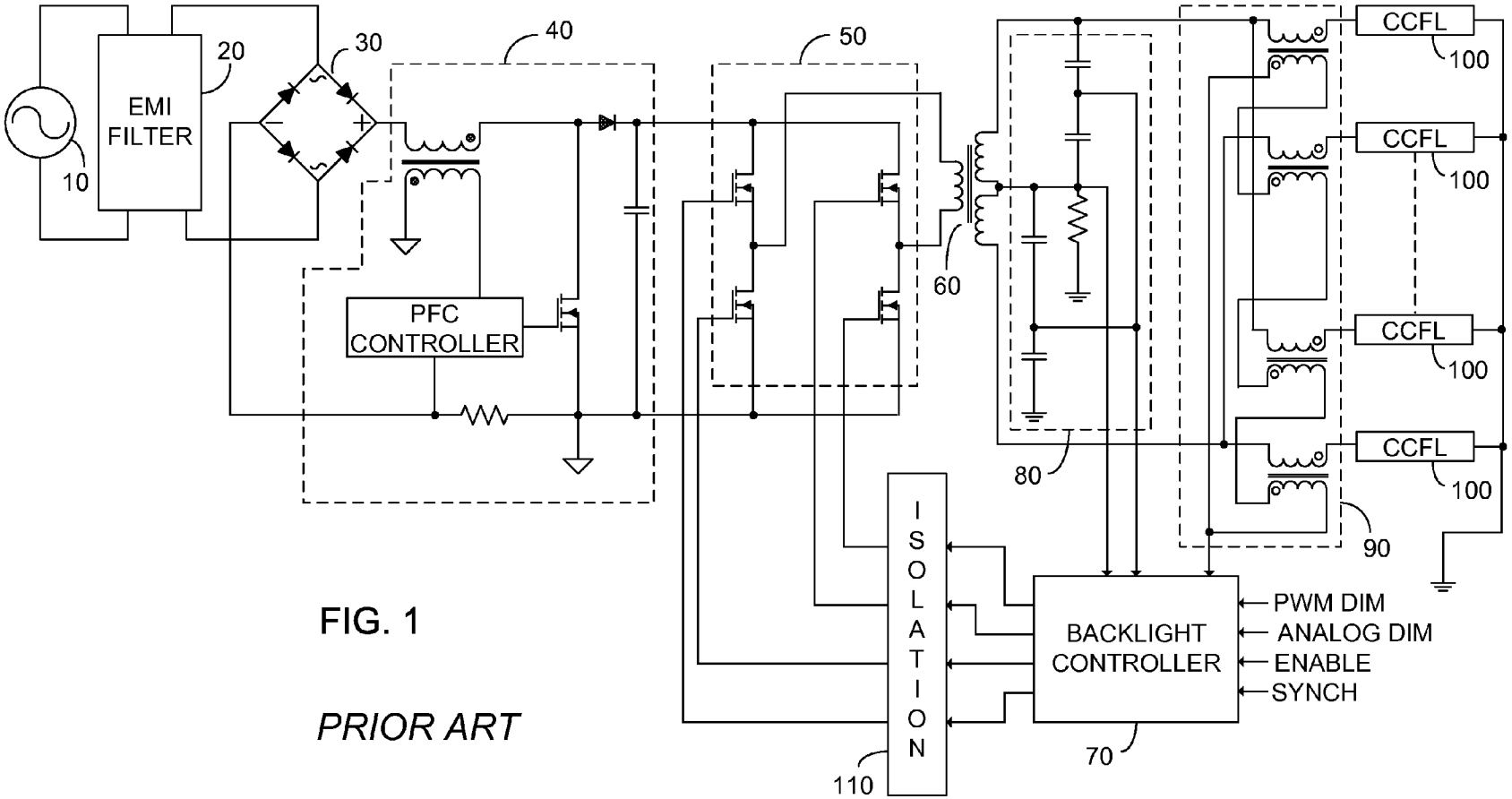
FIG. 1 PRIOR ART
FIG. 1 illustrates a high level schematic diagram of a LIPS driving arrangement according to the prior art, in which a backlight controller is provided associated with the secondary side of a driving transformer.

Before explaining at least one embodiment of the invention in detail, it is to be understood that the invention is not limited in its application to the details of construction and the arrangement of the components set forth in the following description or illustrated in the drawings. The invention is applicable to other embodiments or of being practiced or carried out in various ways. Also, it is to be understood that the phraseology and terminology employed herein is for the purpose of description and should not be regarded as limiting.

Figure 2:
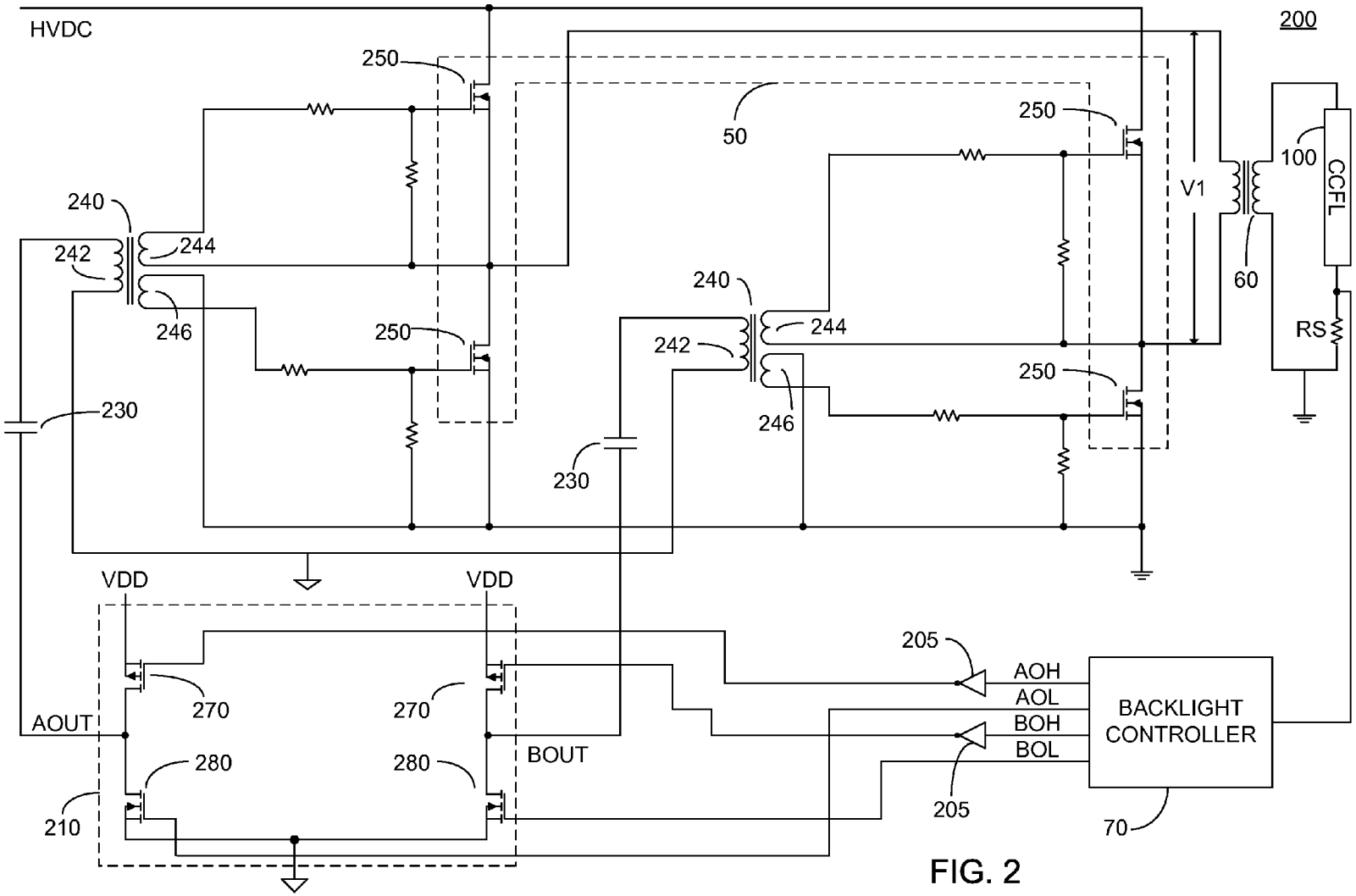
FIG. 2 illustrates a high level schematic diagram of a MOSFET embodiment of a driving arrangement utilizing a high impedance state to pass a switching dead time across isolation transformers illustrated with a CCFL load.

FIG. 2 illustrates a high level schematic diagram of a MOSFET embodiment of a driving arrangement 200 utilizing a high impedance state to pass a switching dead time across isolation transformers and driving a CCFL load. Driving arrangement 200 comprises: a backlight controller 70; a pair of inverters 205; a three state driver 210 constituted of a pair of PMOSFETs 270 and a pair of NMOSFETS 280; a pair of capacitors 230; a pair of transformers 240 each comprising a first winding 242, a second winding 244 and a third winding 246; a first, second, third and fourth electronically controlled switch 250, each illustrated without limitation as an NMOSFET, and arranged to form a switching network 50; an output transformer 60; a sense resistor, denoted RS; and a lamp 100, illustrated without limitation as a CCFL. A single lamp 100 is illustrated for simplicity, however a plurality of lamps as described above in relation to FIG. 1 may be provided without exceeding the scope.

In one embodiment, in the event that a plurality of CCFL lamps 100 are provided, a balancer is further provided (not shown), arranged to balance the current flowing through the plurality of lamps 100.

Backlight controller 70 exhibits 4 switch driving outputs, denoted respectively AOH, AOL, BOH and BOL, respectively arranged to drive a full bridge network with a dead time between the respective on times of the electronically controlled switches in any one arm of the bridge. The dead time may be set so as to only be sufficient to prevent shoot through, or may be expanded for one arm of the bridge so as to produce a lower output voltage. Backlight controller 70 is similar in all respects to commercially available CCFL backlight controllers arranged to operate with a full bridge switching network, and thus the operation of backlight controller 70 will not be detailed further.

The source of each of first and second PMOSFETs 270 is connected to a voltage source, denoted VDD, and the source of each of first and second NMOSFETs 280 are connected to a low voltage side common potential, such as ground. The drain of first PNMOSFET 270 is connected to the drain of first NMOSFET 280, and to a first end of first capacitor 230, the common node of the drains of first PMOSFET 270 and first NMOSFET 280 denoted AOUT. The gate of first PMOSFET 270 is connected to the AOH output of backlight controller 70 via first inverter 205 and the gate of first NMOSFET 280 is connected to the AOL output of backlight controller 70.

The drain of second PMOSFET 270 is connected to the drain of second NMOSFET 280, and to a first end of second capacitor 230, the common node of the drains of second PMOSFET 270 and second NMOSFET 280 denoted BOUT. The gate of second PMOSFET 270 is connected to the BOH output of backlight controller 70 via second inverter 205 and the gate of second NMOSFET 280 is connected to the BOL output of backlight controller 70.

A second end of first capacitor 230 is connected to a first end of first winding 242 of first isolation transformer 240, and a second end of first winding 242 of first isolation transformer 240 is connected to the low voltage side common potential. A second end of second capacitor 230 is connected to a first end of first winding 242 of second isolation transformer 240, and a second end of first winding 242 of second isolation transformer 240 is connected to the low voltage side common potential.

A first end of second winding 244 of first isolation transformer 240 is connected via a respective resistor to the gate of first electronically controlled switch 250, and a second end of second winding 244 of first isolation transformer 240 is connected to the source of first electronically controlled switch 250, to a first end of a first winding of output transformer 60, to the drain of second electronically controlled switch 250, and via a respective resistor to the gate of first electronically controlled switch 250. The drain of first electronically controlled switch 250 is connected to a high DC voltage, denoted HVDC. In one embodiment, voltage HVDC is received from a PFC stage. A first end of third winding 246 of first isolation transformer 240 is connected via a respective resistor to the gate of second electronically controlled switch 250, to the source of second electronically controlled switch 250 and to a high voltage side common potential. A second end of third winding 246 of first isolation transformer 240 is connected via a respective resistor to the gate of second electronically controlled switch 250.

A first end of second winding 244 of second isolation transformer 240 is connected via a respective resistor to the gate of third electronically controlled switch 250, and a second end of second winding 244 of second isolation transformer 240 is connected to the source of third electronically controlled switch 250, to a second end of the first winding of output transformer 60, to the drain of fourth electronically controlled switch 250, and via a respective resistor to the gate of third electronically controlled switch 250. The drain of third electronically controlled switch 250 is connected to voltage HVDC. A first end of third winding 246 of second isolation transformer 240 is connected via a respective resistor to the gate of fourth electronically controlled switch 250 and to the high voltage side common potential. A second end of third winding 246 of second isolation transformer 240 is connected via a respective resistor to the gate of fourth electronically controlled switch 250.

A first end of the second winding of output transformer 60 is connected to a first power lead of lamp 100. A second end of the second winding of output transformer 60 is connected to the high voltage side common potential. A second power lead of lamp 100 is connected to a first end of sense resistor RS and to an input of backlight controller 70 and a second end of sense resistor RS is connected to the high voltage side common potential.

As indicated above, backlight controller 70 is arranged to directly drive a full bridge network, such as switching network 50, with a dead time between turn on of respective switches of each switching arm. Backlight controller 70 drives switching network 50 responsive to the voltage across sense resistor RS. Backlight controller 70 is illustrated as a separate component from three state driver 210 and inverters 205, however this is not meant to be limiting in any way, and backlight controller 70 may implement three state driver 210 without exceeding the scope. Advantageously, driving arrangement 200 only requires a single drive signal, AOUT and BOUT per transformer 240, thus reducing cost and particular pin count in the event that three state driver 210 is incorporated within an integrated circuit backlight controller.

Figures 4A, 4B, 4C, 4D, 4E, 4F, 4G, 4H, 4I, 4J, 4K:
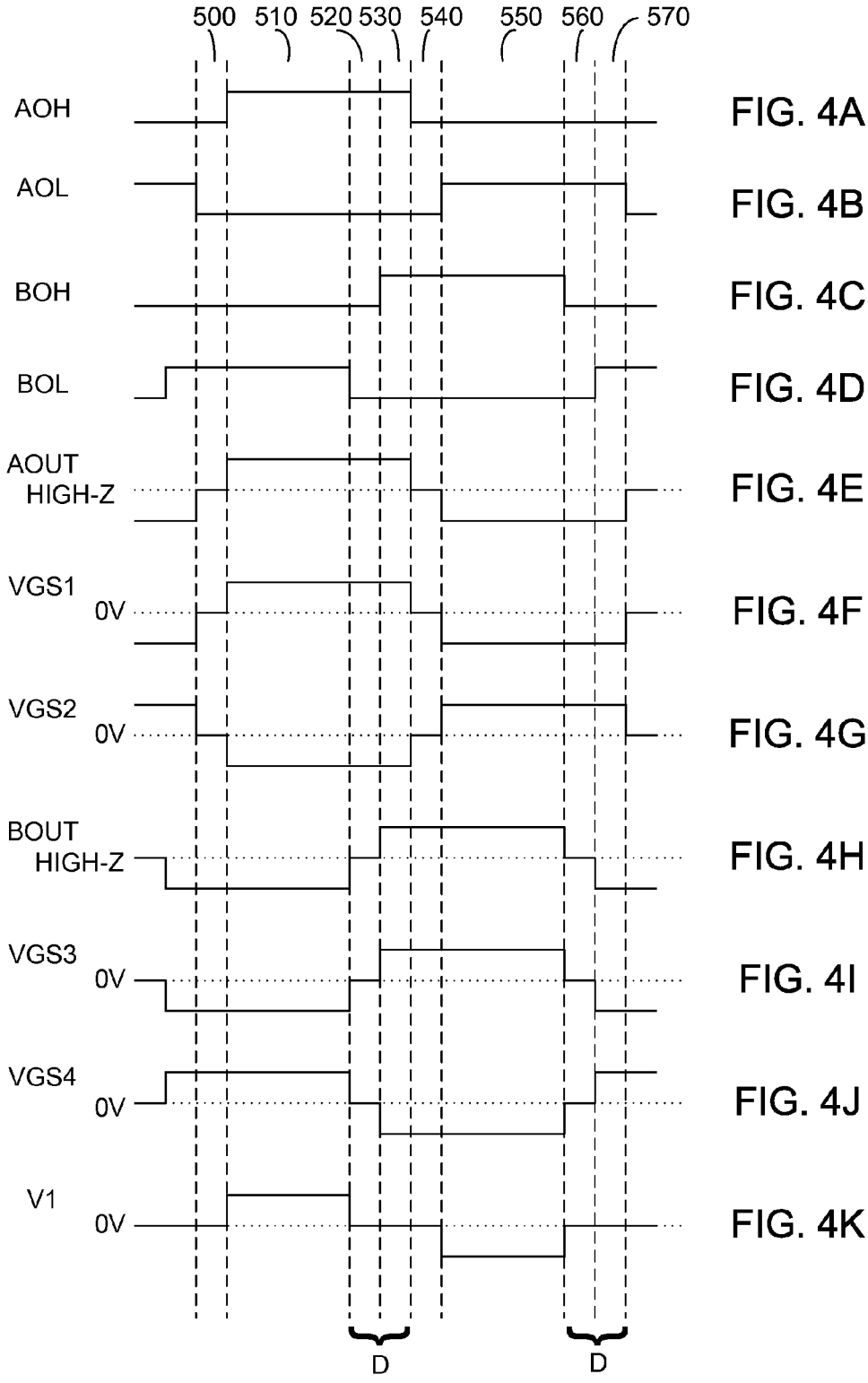
FIGS. 4A-4K illustrate graphs of various signals of the embodiment of either FIG. 1 or FIG. 2 wherein phase control is utilized to control the effective voltage.
Figures 5A, 5B, 5C, 5D, 5E, 5F, 5G, 5H, 5I, 5J, 5K:
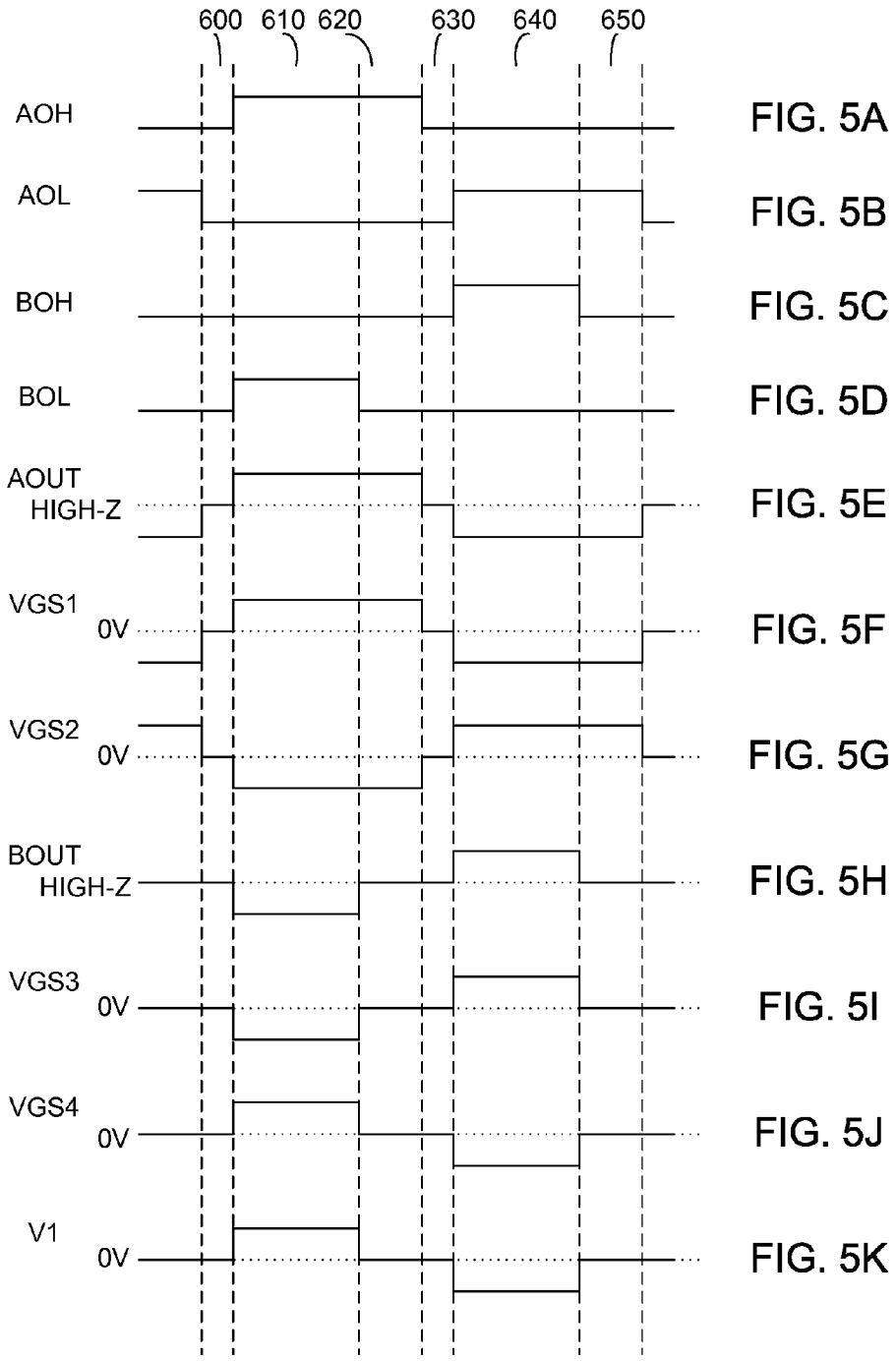
FIGS. 5A-5K illustrate graphs of various signals of the embodiment of either FIG. 1 or FIG. 2 wherein pulse width modulation is utilized to control the effective voltage.

For clarity, operation will be described in relation to FIGS. 4A-4K and FIGS. 5A-5K, wherein the x-axis reflects time on a common scale and the y-axis represents voltage in arbitrary units. In particular: FIG. 4A illustrates signal AOH; FIG. 4B illustrates signal AOL; FIG. 4C illustrates signal BOH; FIG. 4D illustrates signal BOL; FIG. 4E illustrates signal AOUT; FIG. 4F illustrates the gate to source voltage of first electronically controlled switch 250, denoted VGS1; FIG. 4G illustrates the gate to source voltage of second electronically controlled switch 250, denoted VGS2; FIG. 4H illustrates signal BOUT; FIG. 4I illustrates the gate to source voltage of third electronically controlled switch 250, denoted VGS3; FIG. 4J illustrates the gate to source voltage of fourth electronically controlled switch 250, denoted VGS4; and FIG. 4K illustrates the voltage across the first winding of output transformer 60, denoted V1. Similarly, FIG. 5A illustrates signal AOH; FIG. 5B illustrates signal AOL; FIG. 5C illustrates signal BOH; FIG. 5D illustrates signal BOL; FIG. 5E illustrates signal AOUT; FIG. 5F illustrates the gate to source voltage of first electronically controlled switch 250, denoted VGS1; FIG. 5G illustrates the gate to source voltage of second electronically controlled switch 250, denoted VGS2; FIG. 5H illustrates signal BOUT; FIG. 5I illustrates the gate to source voltage of third electronically controlled switch 250, denoted VGS3; FIG. 5J illustrates the gate to source voltage of fourth electronically controlled switch 250, denoted VGS4; and FIG. 5K illustrates the voltage across the first winding of output transformer 60, denoted V1.

In operation, three-state driver 210 is arranged to produce a first signal AOUT, responsive to signals AOH and AOL received from backlight controller 70. First capacitor 230 is preferably of a sufficiently large value to pass the changing reflective states of AOUT without substantial impedance. Thus, when AOUT swings to VDD, a current is driven in a first direction through first winding 242 of first isolation transformer 240, and when AOUT swings to the low voltage side common potential the current is driven through first winding 242 of first isolation transformer 240 in a direction opposite the first direction. Preferably signal AOUT exhibits potential VDD for the same amount of time as the low voltage side common potential thus preventing saturation of first isolation transformer 240. When AOUT is in a high impedance state substantially no current flows through first winding 242 of first isolation transformer 240, since no current path exists. Current flow through first winding 242 of first isolation transformer 240 is reflected to each of second winding 242 and third winding 246 of first isolation transformer 240.

In particular, signal AOUT is placed in a high impedance state, as illustrated at areas 500, 540, 600 and 630, responsive to AOH being driven low and AOL being driven low, i.e. during the dead time instructed by backlight controller 70, since when AOH is low first PMOSFET 270 is turned off by first inverter 205 and first NMOSFET 280 is turned off when AOL is low. As indicated above, no current flows through first winding 242 of first isolation transformer 240 when signal AOUT is in a high impedance state, and thus no current flows through second winding 244 and third winding 246 of first isolation transformer 240. Thus, voltage VGS1 is zero as shown in FIGS. 4F and 5F, thereby first electronically controlled switch 250 does not conduct, and voltage VGS2 is zero as shown in FIGS. 4G and 5G, thereby second electronically controlled switch 250 does not conduct. Since first and second electronically controlled switches 250 and second winding 244 of first isolation transformer 240 are not conducting, no current path is provided to the first winding of output transformer 60, thereby voltage V1 is zero.

Signal AOUT is driven to voltage level VDD, as illustrated at areas 510, 520, 530, 610 and 620, responsive to AOH being driven high and AOL being driven low, since when AOH is high first PMOSFET 270 is turned on by first inverter 205 and first NMOSFET 280 is turned off when AOL is low. As described above, current flows through first winding 242 of first isolation transformer 240 in a first direction and is reflected to second winding 244 and third winding 246 of first isolation transformer 240, where the voltage developed responsive to the reflected current flow develops a positive voltage VGS1 turning on first electronically controlled switch 250 and a negative voltage VGS2 turning off second electronically controlled switch 250. The value of voltage V1 is responsive to both AOUT and BOUT, as will be described further below.

Signal AOUT is driven to the low voltage common potential, as illustrated at areas 550, 560, 570, 640 and 650, responsive to AOH being driven low and AOL being driven high, since when AOH is low first PMOSFET 270 is turned off by first inverter 205 and first NMOSFET 280 is turned on when AOL is high. As described above, current flows through first winding 242 of first isolation transformer 240 in a second direction, opposing the first direction, and is reflected to second winding 244 and third winding 246 of first isolation transformer 240, where the voltage developed responsive to the reflected current flow develops a negative voltage VGS1 turning off first electronically controlled switch 250 and a positive voltage VGS2 turning on second electronically controlled switch 250. The value of voltage V1 is responsive to both AOUT and BOUT, as will be described further below.

Thus, signal AOUT selectively exhibits one of two complementary voltage levels and a high impedance state responsive to the outputs of backlight controller 70, and the complementary voltage levels are reflected via first isolation transformer 240 to alternately close first electronically controlled switch 250 while ensuring that second electronically controlled switch 250 is open and close second electronically controlled switch 250 while ensuring that first electronically controlled switch 250 is open. The high impedance state produces a dead time where both first and second electronically controlled switches 250 are open.

Three-state driver 210 is similarly arranged to produce a second signal BOUT, responsive to signals BOH and BOL received from backlight controller 70. Second capacitor 230 is preferably of a sufficiently large value to pass the changing reflective states of BOUT without substantial impedance. Thus, when BOUT swings to VDD, a current is driven in a first direction through first winding 242 of second isolation transformer 240, and when BOUT swings to the low voltage side common potential the current is driven through first winding 242 of second isolation transformer 240 in a direction opposite the first direction. Preferably signal BOUT exhibits potential VDD for the same amount of time as the low voltage side common potential thus preventing saturation of second isolation transformer 240. When BOUT is in a high impedance state substantially no current flows through first winding 242 of second isolation transformer 240, since no current path exists. Current flow through first winding 242 of second isolation transformer 240 is reflected to each of second winding 242 and third winding 246 of second isolation transformer 240.

In particular, signal BOUT is placed in a high impedance state, as illustrated at areas 520, 560, 600, 620, 630 and 650, responsive to BOH being driven low and BOL being driven low, i.e. during the dead time instructed by backlight controller 70, since when BOH is low second PMOSFET 270 is turned off by second inverter 205 and second NMOSFET 280 is turned off when BOL is low. As indicated above, no current flows through first winding 242 of second isolation transformer 240 when signal BOUT is in a high impedance state, and thus no current flows through second winding 244 and third winding 246 of second isolation transformer 240. Thus, voltage VGS3 is zero as shown in FIGS. 4I and 5I, thereby third electronically controlled switch 250 does not conduct, and VGS4 is zero as shown in FIGS. 4J and 5J, thereby fourth electronically controlled switch 250 does not conduct. Since third and fourth electronically controlled switches 250 and second winding 244 of second isolation transformer 240 are not conducting, no current path is provided to the first winding of output transformer 60, thereby voltage V1 is zero.

Signal BOUT is driven to voltage level VDD, as illustrated at areas 530, 540, 550, and 640, responsive to BOH being driven high and BOL being driven low, since when BOH is high second PMOSFET 270 is turned on by second inverter 205 and second NMOSFET 280 is turned off when BOL is low. As described above, current flows through first winding 242 of second isolation transformer 240 in a first direction and is reflected to second winding 244 and third winding 246 of second isolation transformer 240, where the voltage developed responsive to the reflected current flow develops a positive voltage VGS3 turning on third electronically controlled switch 250 and a negative voltage VGS4 turning off fourth electronically controlled switch 250. The value of voltage V1 is responsive to both AOUT and BOUT, as will be described further below.

Signal BOUT is driven to the low voltage common potential, as illustrated at areas 500, 510, 570 and 610, responsive to BOH being driven low and BOL being driven high, since when BOH is low second PMOSFET 270 is turned off by second inverter 205 and second NMOSFET 280 is turned on when BOL is high. As described above, current flows through first winding 242 of second isolation transformer 240 in a second direction, opposing the first direction, and is reflected to second winding 244 and third winding 246 of second isolation transformer 240, where the voltage developed responsive to the reflected current flow develops a negative voltage VGS3 turning off third electronically controlled switch 250 and a positive voltage VGS4 turning on fourth electronically controlled switch 250. The value of voltage V1 is responsive to both AOUT and BOUT, as will be described further below.

Thus, signal BOUT selectively exhibits one of two complementary voltage levels and a high impedance state responsive to the outputs of backlight controller 70, and the complementary voltage levels are reflected via second isolation transformer 240 to alternately close third electronically controlled switch 250 while ensuring that fourth electronically controlled switch 250 is open and close fourth electronically controlled switch 250 while ensuring that third electronically controlled switch 250 is open. The high impedance state produces a dead time where both third and fourth electronically controlled switches 250 are open.

FIGS. 4A-4K illustrate control of the amplitude of voltage V1, and as a result the voltage presented to lamp 100, and ultimately the current through lamp 100, by phase control. In particular, signal AOUT exhibits a near 100% total duty cycle, i.e. nearly 100% of the time signal AOUT is either active high or active low, except for the dead time portions, as illustrated at areas 500 and 540. To generate a non-zero voltage across V1, both AOUT and BOUT must be simultaneously of opposing values, i.e. either AOUT must be driven to voltage level VDD and BOUT driven to the low voltage common potential, as illustrated at area 510 or AOUT must be driven to the low voltage common potential and BOUT must be driven to voltage level VDD as illustrated at area 550. The phase difference between AOUT and BOUT, illustrated as D, reduces the amount of voltage impressed across the first winding of output transformer 60 and ultimately the amount of current fed to lamp 100. With such a phase difference control, soft switching performance is obtained while allowing for control of voltage V1 and current to lamp 100.

FIGS. 5A-5K illustrate control of the amplitude of voltage V1, and as a result the voltage presented to lamp 100, and ultimately the current through lamp 100, by pulse width modulation of only one of AOUT and BOUT. In particular, signal AOUT exhibits a near 100% total duty cycle, i.e. nearly 100% of the time signal AOUT is either active high or active low, except for the dead time portions illustrated at areas 600 and 630. To generate a non-zero voltage across V1, both AOUT and BOUT must be simultaneously of opposing values, i.e. either AOUT must be driven to voltage level VDD and BOUT driven to the low voltage common potential, as illustrated at area 610 or AOUT must be driven to the low voltage common potential and BOUT must be driven to voltage level VDD as illustrated at area 640. The duty cycle of signal BOUT is reduced and the dead time of signal BOUT is increased so as to reduce the amount of voltage impressed across the first winding of output transformer 60 and ultimately the amount of current fed to lamp 100. Control of current to lamp 100 is thus controlled responsive to the total duty cycle of signal BOUT, while the duty cycle of the active states of signal BOUT is maintained to be symmetric.

Soft switching is preferably still achieved responsive to the inductive current from the first winding of output transformer 60. In particular, in area 610 current flows through the first winding of output transformer 60 through the combination of first electronically controlled switch 250 and fourth electronically controlled switch 250. At the transition to area 620, when fourth electronically controlled switch 250 is turned off, the inductive current from the first winding of output transformer 60 continues to freewheel through the path presented by first electronically controlled switch 250 and the body diode of third electronically controlled switch 250. Since the voltage drop of the freewheel path is low, the inductive current can be sustained until turn on of third electronically controlled switch 250 at area 640, and thus soft switching of third electronically controlled switch 250 is achieved. Similarly, at the transition to area 650, when third electronically controlled switch 250 is turned off, the inductive current from the first winding of output transformer 60 continues to freewheel through the path presented by second electronically controlled switch 250 and the body diode of fourth electronically controlled switch 250. Since the voltage drop of the freewheel path is low, the inductive current can be sustained until turn on of fourth electronically controlled switch 250 during the next cycle at area 610, and thus soft switching of fourth electronically controlled switch 250 is achieved.

Switching network 50 has been described above as being implemented as a full bridge network, however this is not meant to be limiting in any way. In another embodiment, switching network 50 is implemented as a half bridge network.

Figure 3:
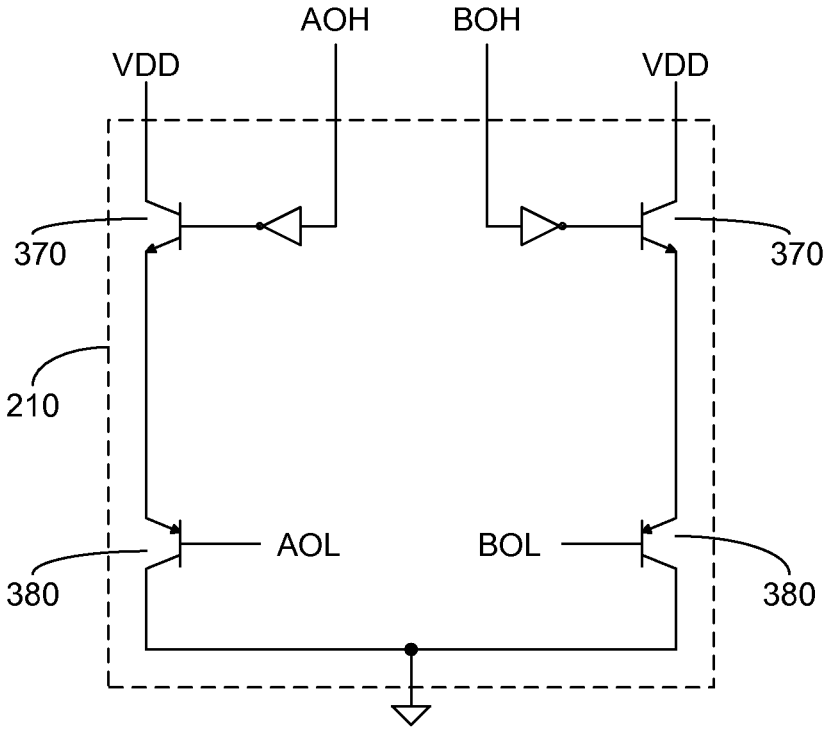
FIG. 3 illustrates a high level schematic diagram of a bipolar transistor embodiment of a driving arrangement utilizing a high impedance state to pass a switching dead time across isolation transformers.

FIG. 3 illustrates a high level schematic diagram of a bipolar transistor embodiment of three-state driver 210 of FIG. 2, comprising a first and second NPN transistor 370 and a first and second PNP transistor 380. The collector of each first and second NPN transistor 370 is connected to voltage source VDD and the collector of each of first and second PNP transistor 380 is connected to the low voltage common potential. The emitter of first NPN transistor 370 is connected to the emitter of first PNP transistor 380 and the emitter of second NPN transistor 370 is connected to the emitter of second PNP transistor 380. The operation of the bipolar transistor embodiment of three-state driver 210 is in all respects similar to the operation of the MOSFET embodiment of three-state driver 210 of FIG. 2 and will not be further described in the sake of brevity.

Figure 6:
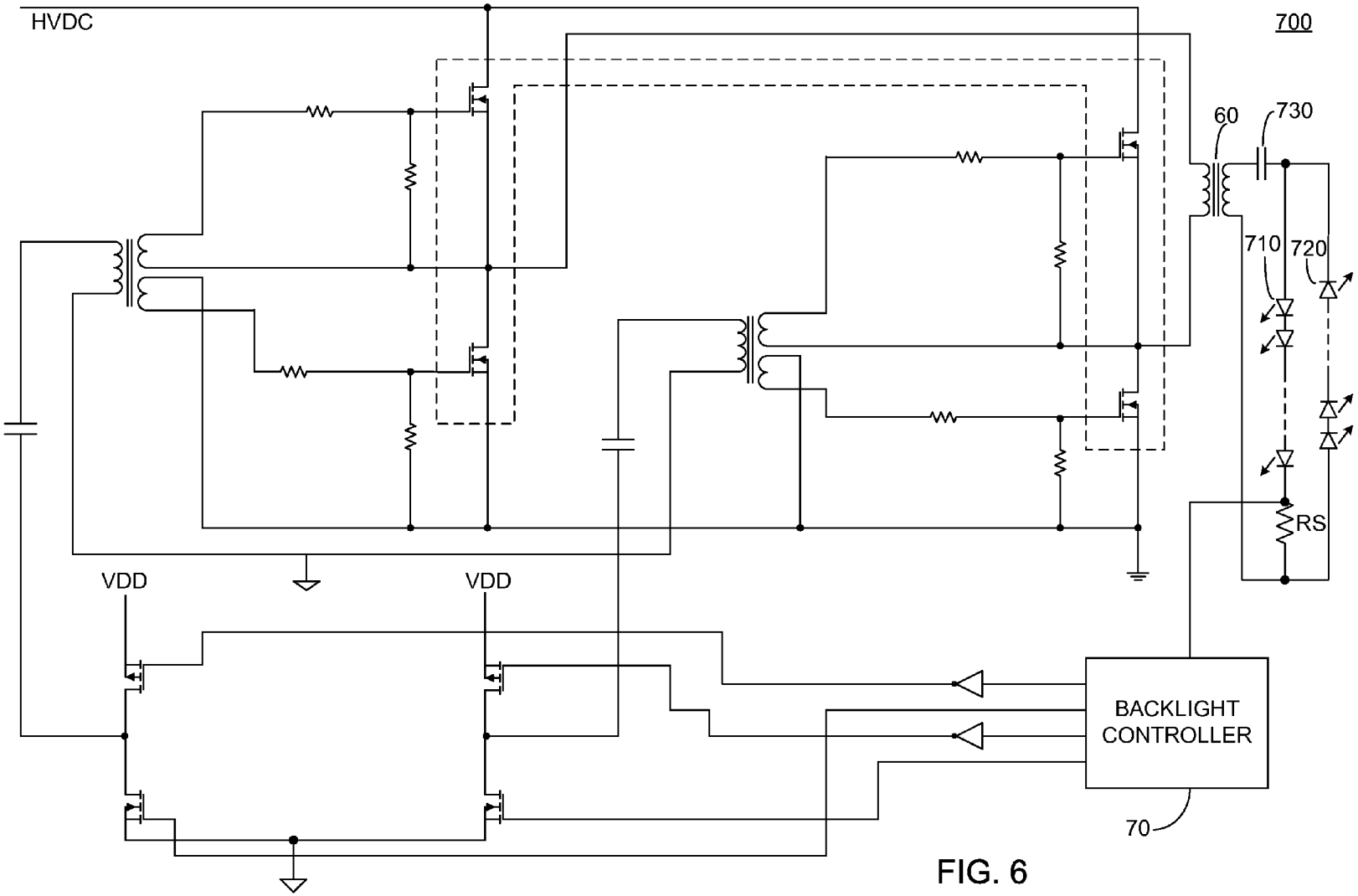
FIG. 6 illustrates a high level schematic diagram of a MOSFET embodiment of a driving arrangement utilizing a high impedance state to pass a switching dead time across isolation transformers illustrated with an LED lighting load.

FIG. 6 illustrates a high level schematic diagram of a MOSFET embodiment of a driving arrangement 700 utilizing a high impedance state to pass a switching dead time across isolation transformers for use with an LED luminaire. Driving arrangement 700 is in all respects similar to driving arrangement 200 of FIG. 2, with the exception that lamp 100 is replaced with a pair of reverse connected LED strings 710 and 720. A first end of the second winding of output transformer 60 is connected to the anode end of LED string 710 and the cathode end of LED string 720 via a capacitor 730. The cathode end of LED string 710 is connected to a first end of sense resistor RS and to an input of backlight controller 70. The anode end of LED string 720 is connected to a second end of sense resistor RS and to a second end of the second winding of output transformer 60. One pair of LED strings 710 and 720 is illustrated, however this is not meant to be limiting in any way and any number of pairs of LED strings may be provided with the anode end of each LED string 710 and the cathode end of each LED string 720 connected to the first end of the second winding of output transformer 60, and the cathode end of LED string 710 and the anode end of LED string 720 connected to the second end of output transformer 60. In one embodiment, a balancer is further provided, arranged to balance the current flowing through the pairs of LED strings. The DC current blocking property of capacitor 730 provides a balancing mechanism to balance the LED current such that the current flowing through LED string 710 during the first half of the AC cycle is equal to the current flowing through LED string 720 during the second half of the AC cycle without producing dissipative loss. If a difference between the operating current and voltage characteristics of the two LED strings 710, 720 exists, a DC offset voltage of will be automatically generated across capacitor 730 so as to maintain the equality of the current flowing through it during the first and second half cycle, and hence match the current flowing through the two LED strings 710, 720.

The operation of driving arrangement 700 is in all respects similar to the operation of driving arrangement 200 and in the interest of brevity will not be further described.

It is appreciated that certain features of the invention, which are, for clarity, described in the context of separate embodiments, may also be provided in combination in a single embodiment. Conversely, various features of the invention which are, for brevity, described in the context of a single embodiment, may also be provided separately or in any suitable sub-combination.

Unless otherwise defined, all technical and scientific terms used herein have the same meanings as are commonly understood by one of ordinary skill in the art to which this invention belongs. Although methods similar or equivalent to those described herein can be used in the practice or testing of the present invention, suitable methods are described herein.

All publications, patent applications, patents, and other references mentioned herein are incorporated by reference in their entirety. In case of conflict, the patent specification, including definitions, will prevail. In addition, the materials, methods, and examples are illustrative only and not intended to be limiting.

It will be appreciated by persons skilled in the art that the present invention is not limited to what has been particularly shown and described hereinabove. Rather the scope of the present invention is defined by the appended claims and includes both combinations and sub-combinations of the various features described hereinabove as well as variations and modifications thereof which would occur to persons skilled in the art upon reading the foregoing description and which are not in the prior art.

I claim:

1. An isolated driving circuitry comprising:

a controller arranged to output a first control signal and a second control signal, wherein the second control signal is the complement of the first control signal with a first inserted dead time when both said first control signal is inactive and said second control signal is inactive;

a first electronically controlled switch;

a second electronically controlled switch;

a three-state driver arranged to receive the first and second control signals and output a first transformer drive signal, wherein said first transformer drive signal is:

in a first state when said first control signal is active and said second control signal is inactive;

in a second state, complementary to said first state, when said first control signal is inactive and said second control signal is active; and in a high impedance state when said first control signal is inactive and said second control signal is inactive;

a first capacitor, a first end of said first capacitor coupled to receive said first transformer drive signal; and a first isolation transformer, comprising a first winding, a second winding and a third winding, said second winding and said third winding of said first isolation transformer magnetically coupled to said first winding of said first isolation transformer, a first end of the first winding of said first isolation transformer coupled to a second end of said first capacitor and a second of said first winding of said first isolation transformer coupled to a return for said first transformer drive signal, the control terminal of said first electronically controlled switch coupled to one end of said second winding of said first isolation transformer and the control terminal of said second electronically controlled switch coupled to one end of said third winding of said first isolation transformer, wherein, responsive to said first transformer drive signal, said first electronically controlled switch is closed when said first control signal is active and said second electronically controlled switch is closed when said second control signal is active.

2. The isolated driving circuitry according to claim 1, wherein said first and second electronically controlled switches are serially connected between a high voltage potential and a low voltage potential.

3. The isolated driving circuitry according to claim 1, further comprising:

a third electronically controlled switch;

a fourth electronically controlled switch;

a second capacitor; and a second isolation transformer comprising a first winding, a second winding and a third winding, said second winding and said third winding of said second isolation transformer magnetically coupled to said first winding of said second isolation transformer, wherein said controller is further arranged to output a third control signal and a fourth control signal, wherein the fourth control signal is the complement of the third control signal with a second inserted dead time when both said third control signal is inactive and said fourth control signal is inactive, wherein said three-state driver is further arranged to receive the third and fourth control signals and output a second transformer drive signal, wherein said second transformer drive signal is:

in a first state when said third control signal is active and said fourth control signal is inactive;

in a second state, complementary to said first state, when said third control signal is inactive and said fourth control signal is active; and in a high impedance state when said third control signal is inactive and said fourth control signal is inactive, wherein a first end of said second capacitor is coupled to receive said second transformer drive signal; and wherein a first end of the first winding of said second isolation transformer is coupled to a second end of said second capacitor and a second of said second winding of said second isolation transformer is coupled to a return for said second transformer drive signal, the control terminal of said third electronically controlled switch coupled to one end of said second winding of said second isolation transformer and the control terminal of said fourth electronically controlled switch coupled to one end of said third winding of said second isolation transformer, wherein, responsive to said second transformer drive signal, said third electronically controlled switch is closed when said third control signal is active and said fourth electronically controlled switch is closed when said fourth control signal is active.

4. The isolated driving circuitry according to claim 3, wherein said third and fourth electronically controlled switches are serially connected between a high voltage potential and a low voltage potential, said first, second, third and fourth electronically controlled switches arranged in a full bridge arrangement to drive an output transformer.

5. The driving circuitry according to claim 4, wherein said output transformer is coupled to a fluorescent lamp thereby producing illumination.

6. The driving circuitry according to claim 4, wherein said output transformer is coupled to an LED string thereby producing illumination.

7. The driving circuitry according to claim 1, wherein said three-state driver comprises a pair of field effect transistors of complementary types in a totem pole arrangement.

8. The driving circuitry according to claim 1, wherein said three-state driver comprises a pair of bipolar transistors of complementary types in a totem pole arrangement.

9. A method of driving electronically controlled switches with signals passed over an isolation transformer, the method comprising:

receiving a first control signal and a second control signal, wherein the received second control signal is the complement of the received first control signal with a first inserted dead time when both said received first control signal is inactive and said received second control signal is inactive;

generating a first transformer drive signal responsive to the received first control signal and received second control signal, wherein said generated first transformer drive signal is:

in a first state when said received first control signal is active and said received second control signal is inactive;

in a second state, complementary to said first state, when said received first control signal is inactive and said received second control signal is active; and in a high impedance state when said received first control signal is inactive and said received second control signal is inactive;

providing a first isolation transformer having a first winding, a second winding and a third winding, the first winding of the provided first isolation transformer magnetically coupled to each of the second winding and the third winding of said provided first isolation transformer;

coupling the first winding of said provided first isolation transformer through a first capacitor to said generated first transformer drive signal;

coupling a control terminal of a first electronically controlled switch to said second winding of said provided first isolation transformer; and coupling a control terminal of a second electronically controlled switch to said third winding of said provided first isolation transformer, wherein, responsive to said generated first transformer drive signal, the first electronically controlled switch is closed when said received first control signal is active and the second electronically controlled switch is closed when said received second control signal is active.

10. The method of claim 9, wherein both the first and second electronically controlled switches are open when said first transformer drive signal is in the high impedance state.

11. The method of claim 9, further comprising:

receiving a third control signal and a fourth control signal, wherein the received fourth control signal is the complement of the received third control signal with a second inserted dead time when both said received third control signal is inactive and said received fourth control signal is inactive;

generating a second transformer drive signal responsive to the received third control signal and the received fourth control signal, wherein said generated second transformer drive signal is:

in a first state when said received third control signal is active and said received fourth control signal is inactive;

in a second state, complementary to said first state, when said received third control signal is inactive and said received fourth control signal is active; and in a high impedance state when said received third control signal is inactive and said received fourth control signal is inactive;

providing a second isolation transformer having a first winding, a second winding and a third winding, the first winding of the provided second isolation transformer magnetically coupled to each of the second winding and the third winding of said provided second isolation transformer;

coupling the first winding of said provided second isolation transformer through a second capacitor to said generated second transformer drive signal;

coupling a control terminal of a third electronically controlled switch to the second winding of said provided second isolation transformer; and coupling a control terminal of a fourth electronically controlled switch to the third winding of said provided second isolation transformer, wherein responsive to said generated second transformer drive signal, the third electronically controlled switch is closed when said received third control signal is active and the fourth electronically controlled switch is closed when said received fourth control signal is active.

12. The method of claim 11, wherein both the first and second electronically controlled switches are open when said generated first transformer drive signal is in the high impedance state and both the third and fourth electronically controlled switches are open when said generated second transformer drive signal is in the high impedance state.

13. The method of claim 12, further comprising:

driving an output transformer responsive to the first, second, third and fourth electronically controlled switches.

14. The method of claim 13, further comprising:

generating said first, second, third and fourth control signals; and controlling the amount of voltage generated by said driven output transformer responsive to the phase relationship between said generated first control signal and said generated third control signal.

15. The method of claim 13, further comprising:

generating said first, second, third and fourth control signals; and controlling the amount of voltage generated by said driven output transformer by controlling the amount of said second dead time.

16. The method of claim 13, further comprising:

producing illumination responsive to said driving of the output transformer.

17. An isolated driving circuitry comprising:

an input connection arranged to receive a first control signal and a second control signal, wherein the second control signal is the complement of the first control signal with a first inserted dead time when said first control signal is inactive and said second control signal is inactive;

a first electronically controlled switch;

a second electronically controlled switch;

a first isolation transformer, comprising a first winding, a second winding and a third winding, said second winding and said third winding of said first isolation transformer magnetically coupled to said first winding of said first isolation transformer;

a first capacitor; and a three-state driver arranged to receive the first and second control signals and output a first transformer drive signal, wherein said first transformer drive signal is:

in a first state when said first control signal is active and said second control signal is inactive;

in a second state, complementary to said first state, when said first control signal is inactive and said second control signal is active; and in a high impedance state when said first control signal is inactive and said second control signal is inactive, wherein the first winding of said first isolation transformer is coupled via said first capacitor to the output first transformer drive signal of said three-state driver, the control terminal of said first electronically controlled switch is coupled to said second winding of said first isolation transformer and the control terminal of said second electronically controlled switch is coupled to said third winding of said first isolation transformer, and wherein, responsive to said first transformer drive signal, said first electronically controlled switch is closed when said first control signal is active and said second electronically controlled switch is closed when said second control signal is active.

18. The isolated driving circuitry according to claim 17, further comprising:

a third electronically controlled switch;

a fourth electronically controlled switch;

a second isolation transformer comprising a first winding, a second winding and a third winding, said second winding and said third winding of said second isolation transformer magnetically coupled to said first winding of said second isolation transformer; and a second capacitor, wherein said input connection is further arranged to receive a third control signal and a fourth control signal, wherein the fourth control signal is the complement of the third control signal with a second inserted dead time when both said third control signal and said fourth control signal is inactive;

wherein said three-state driver is further arranged to output a second transformer drive signal, wherein said second transformer drive signal is:

in a first state when said third control signal is active and said fourth control signal is inactive;

in a second state, complementary to said first state, when said third control signal is inactive and said fourth control signal is active; and in a high impedance state when said third control signal is inactive and said fourth control signal is inactive;

wherein the first winding of said second isolation transformer is coupled via said second capacitor to the output second transformer drive signal of said three-state driver, the control terminal of said third electronically controlled switch is coupled to said second winding of said second isolation transformer and the control terminal of said fourth electronically controlled switch is coupled to said third winding of said second isolation transformer; and wherein, responsive to said second transformer drive signal, said third electronically controlled switch is closed when said third control signal is active and said fourth electronically controlled switch is closed when said fourth control signal is active.

19. The isolated driving circuitry according to claim 18, wherein said first and second electronically controlled switches are serially connected between a high voltage potential and a low voltage potential, and said third and fourth electronically controlled switches are serially connected between the high voltage potential and the low voltage potential, said first, second, third and fourth electronically controlled switches arranged in a full bridge arrangement to drive an output transformer.

20. The isolated driving circuitry according to claim 17, wherein responsive to said first transformer drive signal both said first electronically controlled switch and said second electronically switch are open during said first inserted dead time.

* * * * *